US007565086B2

(12) United States Patent
Tsujimura

(10) Patent No.: US 7,565,086 B2
(45) Date of Patent: Jul. 21, 2009

(54) POWER CONTROL OF IMAGE FORMING APPARATUS

(75) Inventor: Yoshihiro Tsujimura, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 415 days.

(21) Appl. No.: 11/371,436

(22) Filed: Mar. 8, 2006

(65) Prior Publication Data

US 2007/0212092 A1 Sep. 13, 2007

(51) Int. Cl.
*G03G 15/00* (2006.01)
*G03G 15/20* (2006.01)

(52) U.S. Cl. ..... 399/37; 399/70

(58) Field of Classification Search ..... 399/37, 399/43, 69, 70, 88, 320, 328, 330; 219/216
See application file for complete search history.

(56) References Cited

U.S. PATENT DOCUMENTS 5,194,895 A * 3/1993 Bares ..... 399/82
5,241,349 A * 8/1993 Nagasaka ..... 399/70
5,321,478 A * 6/1994 Nakamura et al. ..... 399/70
5,724,630 A 3/1998 Mashiba
6,895,309 B2 * 5/2005 Ito ..... 700/296

FOREIGN PATENT DOCUMENTS

JP H05-19655 1/1993
JP 07110636 A * 4/1995
JP 07199746 A * 8/1995
JP H08-241009 9/1996
JP H11-316517 11/1999
JP 2005-37611 2/2005
JP 2006011331 A * 1/2006

* cited by examiner

*Primary Examiner*—Robert Beatty
(74) *Attorney, Agent, or Firm*—SoCal IP Law Group LLP; Steven C. Sereboff; John E. Gunther

(57) ABSTRACT

According to an aspect of the present invention, an image forming apparatus comprising: a heater heating unit configured to heat a heater at a first temperature or a second temperature lower than the first temperature when waiting for fixation of a formed image; and a heat control unit configured to heat the heater at the first temperature when the estimated amount of power consumption is significant and to control the heater heating unit so as to heat the heater at the second temperature when the estimated amount of power consumption is small on the basis of distribution of the estimated amount of power consumption consumed by the fixation with time for a certain period of time is obtained is provided.

2 Claims, 6 Drawing Sheets

POWER CONTROL OF IMAGE FORMING APPARATUS

BACKGROUND OF THE INVENTION

1. Field of the Invention

The present invention relates to an image forming apparatus and, more specifically, to an image forming apparatus that changes a waiting state according to the time zone.

2. Description of the Related Art

Generally, in the image forming apparatus, a latent image is formed as an image on a photoconductor drum, the latent image is developed by applying toner thereon, and transferred and fixed by a heated roller. An amount of power consumption by the heated roller is significant. Therefore, if the temperature of the heated roller can be lowered at this part on standby, a power saving effect is significant. However, it takes time for heating the same to a predetermined temperature when a job command such as copying is issued. Therefore, a technology to obtain data on print output frequency in the past to adjust the temperature on standby on the basis of the obtained data is known (see JP-A-11-316517). However, there is a problem such that how much amount of power consumption can be reduced cannot be figured out by intuition even when the print output frequency in the past is obtained.

BRIEF SUMMARY OF THE INVENTION

In view of such problems of the image forming apparatus in the related art as shown above, the invention provides an image forming apparatus in which the amount of reduction of power consumption can be figured out by intuition.

According to an aspect of the invention, an image forming apparatus including a heater heating unit configured to heat a heater at a first temperature or a second temperature lower than the first temperature when waiting for fixation of a formed image, and a heat control unit configured to heat the heater at the first temperature when an estimated amount of power consumption is significant and to control the heater heating unit so as to heat the heater at the second temperature when the estimated amount of power consumption is small on the basis of distribution of the estimated amount of power consumption consumed by the fixation with time for a certain period of time is obtained.

According to the aspect of the invention, the image forming apparatus in which control according to the frequency of copying operation for each time zone so that the amount of reduction of electric energy can be figured out by intuition can be obtained.

DETAILED DESCRIPTION OF THE INVENTION

Figure 1:
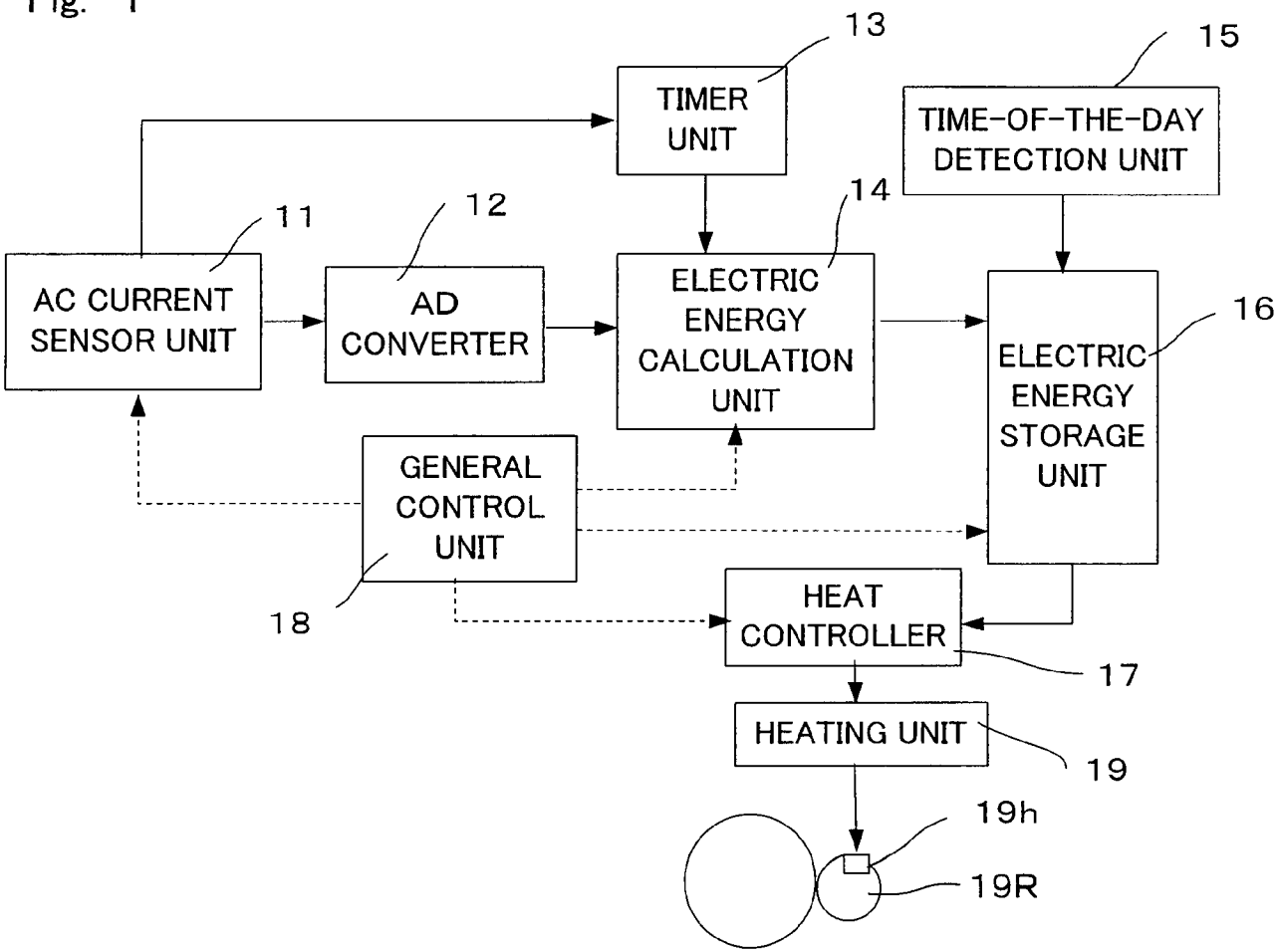
FIG. 1 is a drawing showing a structure of an image forming apparatus according to an embodiment of the invention.

Referring now to the drawings, embodiments of the invention will be described. FIG. 1 shows a general configuration of an embodiment of an image forming apparatus according to the invention.

First Embodiment

In the first embodiment, a case in which three modes including a normal mode that requires, for example, 15 minutes, as preheating-to-sleep transition time, a preheating mode that requires shorter transition time and a sleep mode that gives way to sleep directly without preheating are switched in a day based on the power consumption data of a day will be described below.

An image forming apparatus 10 includes an AC current sensor unit 11 for detecting supplied electric current from the AC power source, an AD converter 12 for converting electric current and voltage values of the AC current sensor unit 11 from analogue to digital, a timer unit 13 for measuring time period of current supply detected by the AC current sensor unit, an electric energy calculating unit 14 for calculating an amount of electric energy by multiplying an output from the timer unit 13 by an output value of the AD converter 12, a time-of-the-day detection unit 15 for detecting current time, an electric energy storage unit 16 for storing the amount of electric energy calculated by the electric energy calculating unit 14 together with the time-of-the-day detected by the time-of-the-day detection unit 15, a heat controller 17 for controlling a power saving mode at each time-of-the-day on the basis of distribution data of the amount of power consumption at each time-of-the-day stored in the electric energy storage unit 16, and a general control unit 18 for generally controlling the AC current sensor unit 11, the electric energy calculating unit 14, the electric energy storage unit 16, and the heat controller 17. The heat controller 17 controls heating of a fixing roller 19R used in a fixing step by a heater 19*h* of a heating unit 19. Reference numeral 20 is a drum on which a latent image is formed.

Subsequently, using the flowchart shown in FIG. 2, the operation of this embodiment of the invention will be described. The operation includes two phases; a measuring phase for measuring distribution of an amount of power consumption of the image forming apparatus in a day, and a control phase for switching a heating mechanism into three modes on the basis of the measured data.

When started, the operation is in the measuring phase. In Step S201, current flowing in the image forming apparatus is detected by the AC current sensor unit 11 and converted into a digital value by the AD converter 12, and the timer unit 13 starts to measure time. In the next Step S202, the timer unit 13 measures a time period during which the current flows. In Step S203, the electric energy calculating unit 14 calculates an amount of power consumption at that time from the time period measured by the timer unit 13 and the digital current value outputted from the AD converter 12.

In the next Step S204, the time-of-the-day detection unit 15 detects the time-of-the-day at that moment, and in Step S205, the amount of power consumption calculated by the electric energy calculating unit 14 as a value of the time-of-the-day at that moment is temporarily stored in the electric energy storage unit 16.

In Step S206, whether or not measurement of the amount of power consumption of the day will be ended is determined. In this case, measurement is ended after having inspected the amount of power consumption for two days. In Step S207, for example, the amount of power consumption, for example, at each time of the day is averaged. The averaged amount of power consumption is estimated to be the normal amount of power consumption of weekday, and hence it is referred to as an estimated amount of power consumption.

In the case described above, for example, the amount of power consumption is measured for two weekdays, and the fixed control for the weekday is performed on the basis of the data.

When the control phase for fixing described later is performed every day of the week, measurement of the amount of power consumption is stored for every day of the week.

Figure 3:
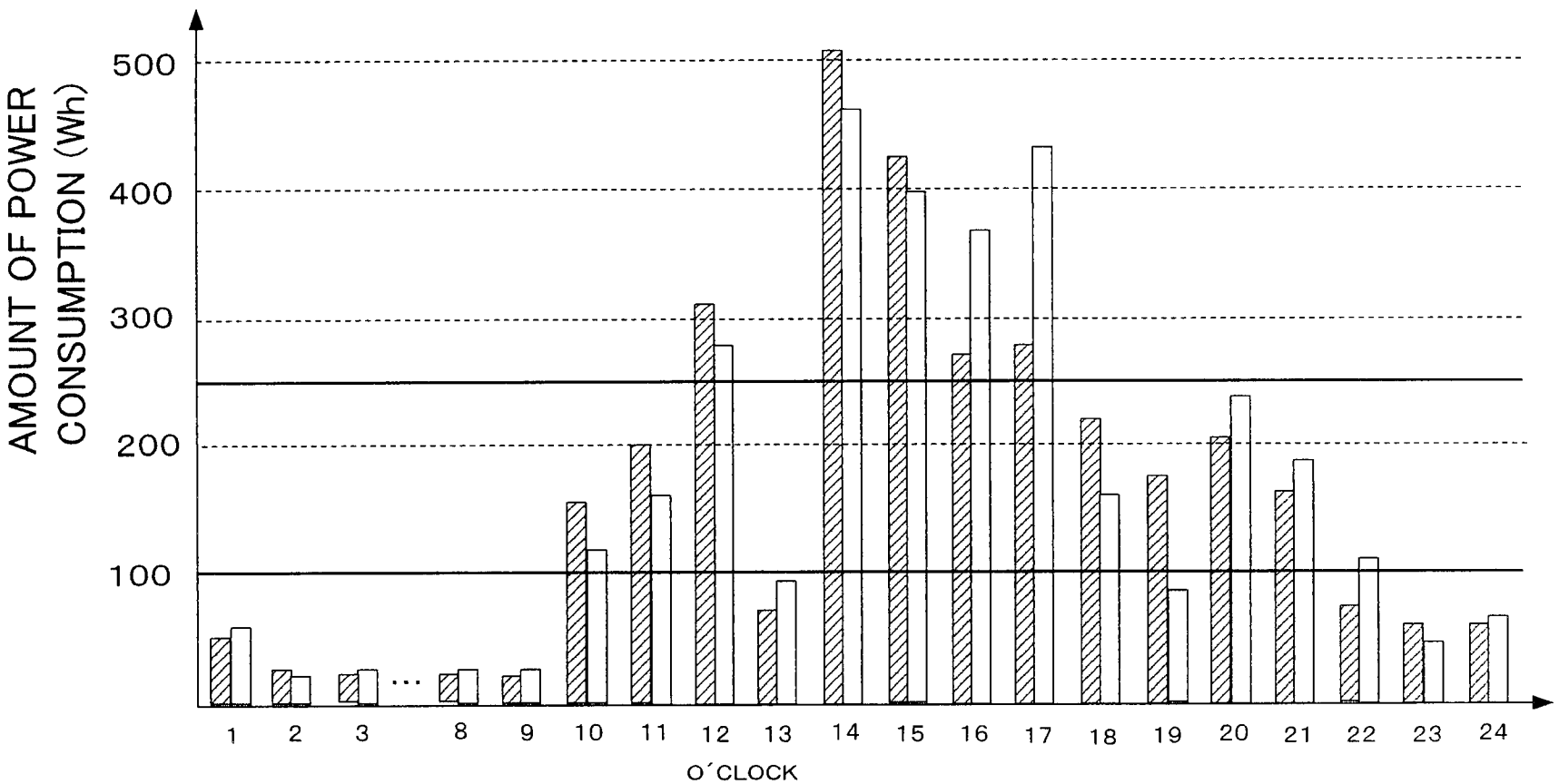
FIG. 3 is a drawing for explaining a power saving mode to be selected in the image forming apparatus according to the first embodiment of the invention.

In this manner, the amount of power consumption is measured every unit time, for example, every hour for one day, 24 hours. Such a measurement is performed for, for example, two weekdays. The result will be as shown in FIG. 3. In this graph, the lateral axis represents every hour of the day, and the vertical axis represents the amount of power consumption at every time of the day, for an hour, for example, before to after 30 minutes thereof. The amount of power consumption is substantially proportional to the frequency of usage of the image forming apparatus.

From this graph, for example, the amount of power consumption is low from 1 o'clock to 9 o'clock, and is increased gradually from 10 o'clock, and is decreased at 13 o'clock. Then, from 14 o'clock, the amount of power consumption is increased, and from then on is decreased gradually, but a certain amount of power consumption remains. It represents the frequency of usage of the image forming apparatus. In the first day, the amount of power consumption is high at 14 o'clock and 15 o'clock. In the second day, the amount of power consumption is relatively high at 16 o'clock and 17 o'clock as well as the time described above.

Therefore, in the next control phase, the three types of power saving modes are switched under control on the basis of the data of the above-described amount of power consumption of a weekday obtained in the distribution measuring phase.

Here, the normal mode, the preheating mode, and the sleep mode as the three power saving modes will be described. The temperature states of a fixing heater includes three states; a high temperature state in which a temperature Tn sufficient for fixation is maintained, for example, when copying, a state in which the temperature (preheated temperature) Tp is lower than the high temperature and has to be increased to the above-described Tn from the present temperature Tp for actually performing the fixation, and a state in which the temperature (sleep temperature) Ts is further lower, at which the heater control is OFF and hence heating to the above-described temperature Tn is necessary for actually performing copying or the like.

In this case, a mode in which the fixing heater is increased to the above-described temperature Tn and the processing such as copying is performed, then the preheated temperature Tp is maintained, for example, for 15 minutes, and then the temperature changes the above-described sleep temperature Ts for 15 minutes is referred to as normal mode, which is set as a default mode even with the initial value unless otherwise set.

A mode in which the fixing heater is heated at the above-described preheated temperature Tp within a period shorter than 15 minutes, and then the fixing heater changes to the sleep temperature Ts within a period shorter than 15 minutes is referred to as preheating mode, while a mode in which the fixing heater is not preheated, and is maintained at the sleep temperature Ts within a period shorter than 15 minutes is referred to as the sleep mode. Therefore, when the preheating mode is selected, the power saving effect is achieved in comparison with the normal mode, but it takes time until the processing such as copying is performed. Furthermore, in the sleep mode, the power saving effect is further enhanced, but it takes time until the processing such as copying is performed. By switching these modes according to the estimated amount of power consumption, the power saving effect can be achieved sufficiently without too much inconvenience.

For example, it is assumed that the sleep mode is selected when the estimated amount of power consumption is lower than 100 Wh, the preheating mode is selected when the estimated amount of power consumption is between 100 Wh to 250 Wh, and the normal mode is selected when it is higher than 250 Wh.

Then, the sleep mode is selected before to after 30 minutes of 1 to 9 o'clock, 13 o'clock, and 22 to 24 o'clock, the preheating mode is selected before to after 30 minutes of 10 o'clock, 11 o'clock, and 18 to 21 o'clock, and the normal mode is selected before to after 30 minutes of 14 to 17 o'clock. The switching of the power saving modes with respect to the estimated amount of power consumption and hence the time-of-the-day is performed by the heat controller 17 that receives output signals from the electric energy storage unit 16 and, actually, the heat controller 17 controls the fixing heater (not shown).

Figure 2:
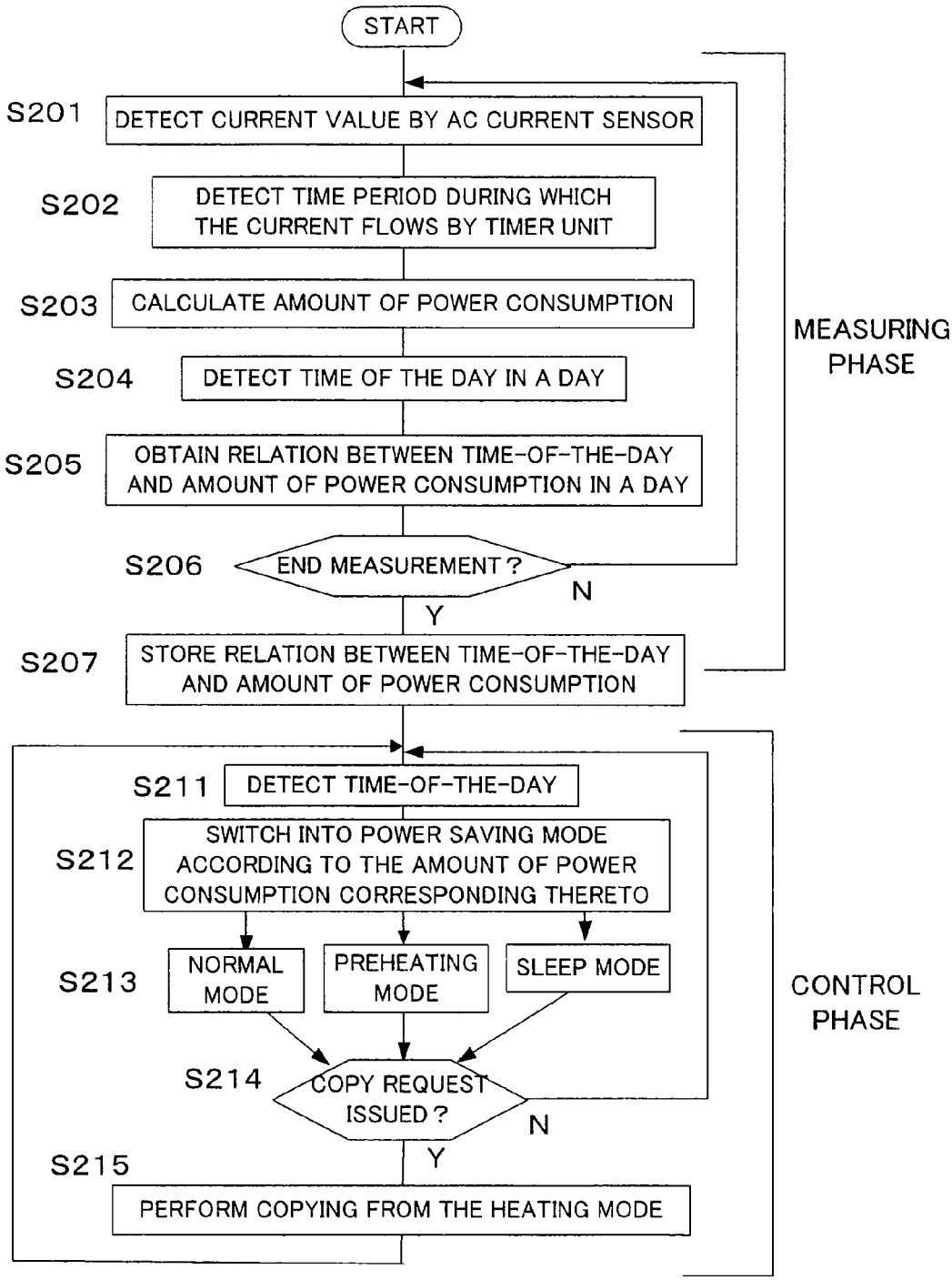
FIG. 2 is an explanatory drawing showing an operation of the image forming apparatus according to a first embodiment of the invention.

Referring now to FIG. 2, the control phase is described. In Step S211, the time-of-the-day is detected, and in Step S212, the power saving mode is changed to a mode which corresponds to the estimated amount of power consumption at the time-of-the-day. Therefore, in Step S213, the mode is any one of the normal mode, the preheating mode, and the sleep mode. In Step S214, for example, whether or not copy request is issued is detected. If yes, the mode is restored from one of the normal mode, the preheating mode, and the sleep mode for copying operation in Step S215. In the normal mode, the copying operation is performed relatively quickly. In the preheating mode, the copying operation is performed after a period longer than the case of the normal mode, and when the copying operation is requested in the sleep mode, the copying operation is performed after a period still longer than the preheating mode.

Second Embodiment

In the embodiment described above, the estimated amounts of power consumption at every hour are obtained and the power saving mode is changed within a day on the basis of the past record of the amount of power consumption in a weekday. However, the period for obtaining the past result is not limited to a day, and the amount of power consumption for a long term such as one month may be obtained. In this case, the second embodiment of the invention in which the amount of power consumption for two months is measured, and the power saving mode is changed according to the date, the date of the week, and the time-of-the-day on the basis of the measured result will be described. The configuration of this embodiment is shown in FIG. 1.

Figure 4:
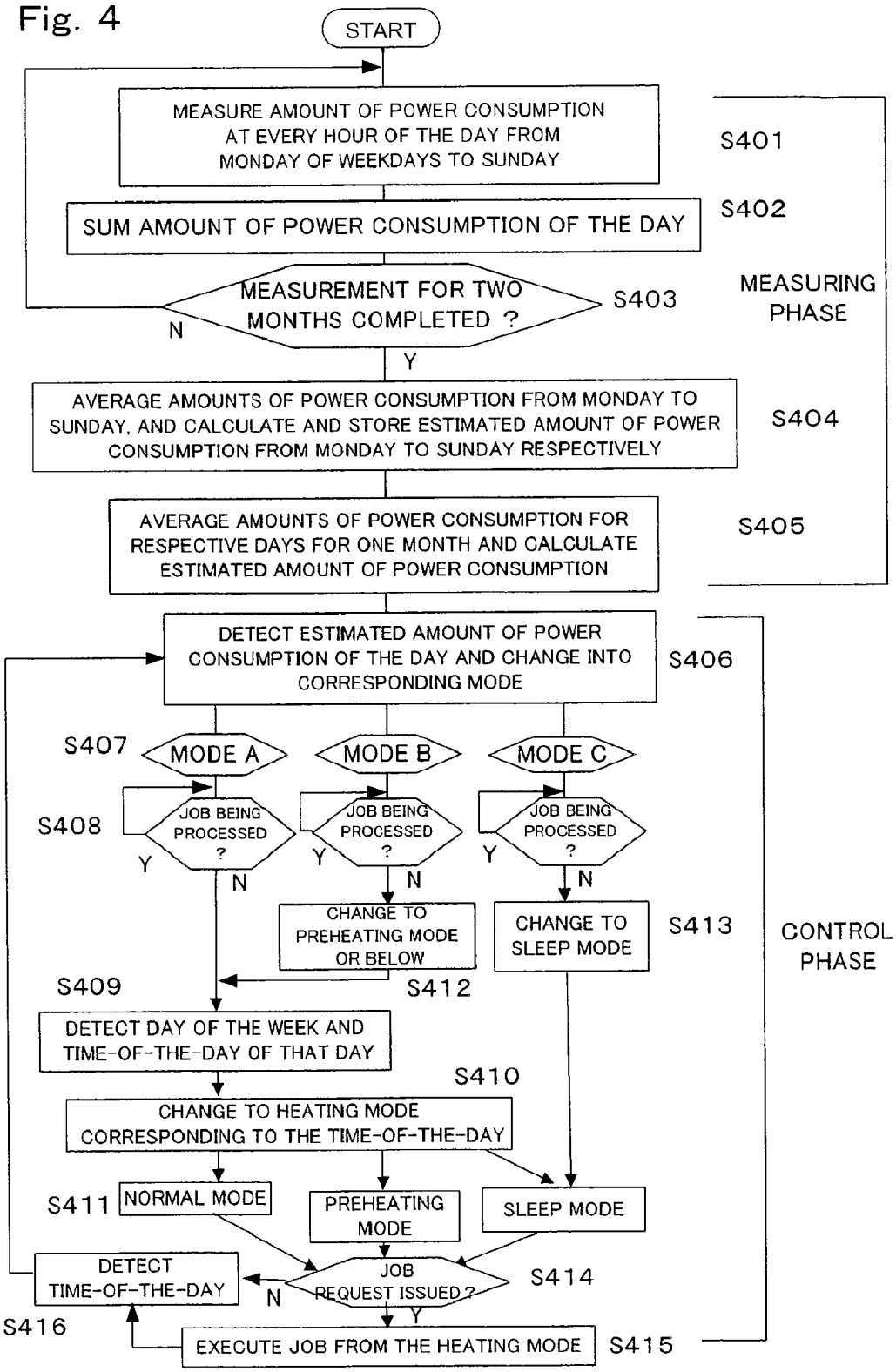
FIG. 4 is an explanatory drawing showing the operation of the image forming apparatus according to a second embodiment of the invention.

In this case as well, as shown in FIG. 4, there are the measuring phase for measuring the amount of power consumption and the control phase for switching the power saving mode on the basis of the estimated amount of power consumption obtained by calculation.

The measurement of the amount of power consumption is performed in the following manner. In Step S401, the amounts of power consumption in a period before to after 30 minutes of every hour of the day from Monday to Sunday are measured, In Step S402, the total amount of power consumption of the day is calculated. In this manner, the amount of power consumption of every hour of everyday and the amount of power consumption of every day are measured, and in Step S403, whether or not measurement for two months is completed is detected. Calculation and storage of the amount of power consumption of every hour of every day and the amount of power consumption of the day are performed by the electric energy calculating unit 14, the time-of-the-day detection unit 15 and the electric energy storage unit 16.

When the fact that the measurement for two months is not completed is detected in Step S403, the procedure returns back to Step S401 again for measuring the amount of power consumption. When the fact that the measurement for two months is completed is detected in Step S403, the amounts of electric energy for every day of the week from Monday to Sunday are calculated to obtain an average amount of power consumption. The obtained amounts correspond to the estimated amounts of power consumption for a day for the respective days of the week. On the other hand, in Step S405, the average amount of power consumption is calculated by summing the amounts of power consumption of the respective days for two months and dividing the result by two. The obtained amounts correspond to the estimated amounts of power consumption for the respective days of a month. These estimated amounts of power consumption are stored in the electric energy storage unit 16 shown in FIG. 1, and the measuring phase is terminated.

In the subsequent control phase, the power saving mode is changed according to the estimated amount of power consumption and the total amount of power consumption for each month as described above.

Figure 5A:
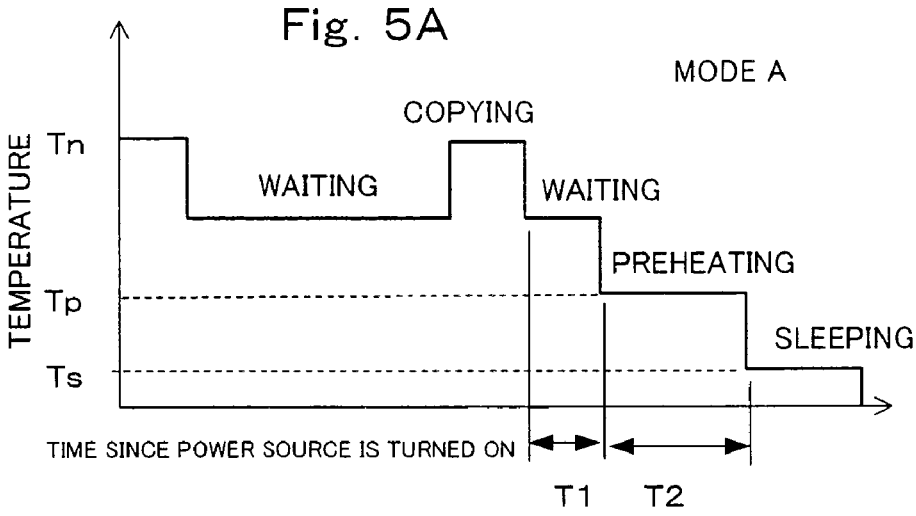
FIG. 5A is a drawing showing a variation in temperature of the image forming apparatus in Mode A according to the second embodiment of the invention.
Figure 5B:
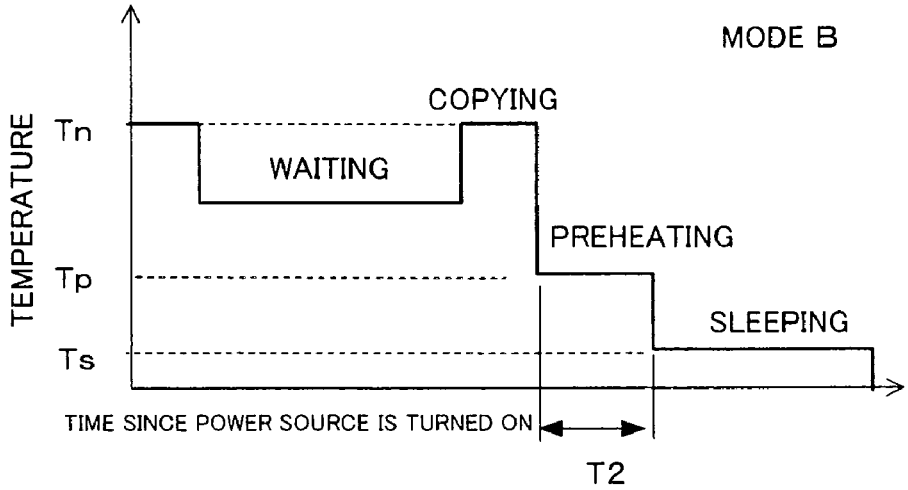
FIG. 5B is a drawing showing a variation in temperature of the image forming apparatus in Mode B according to the second embodiment of the invention.
Figure 5C:
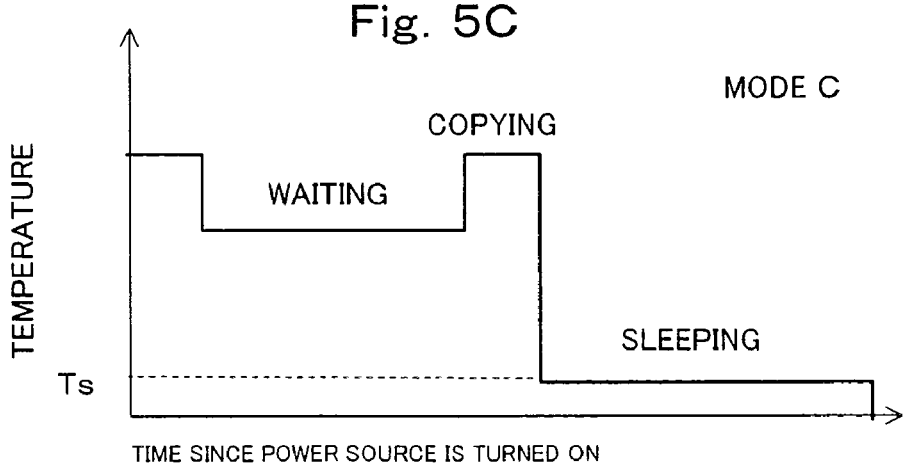
FIG. 5C is a drawing showing a variation in temperature of the image forming apparatus in Mode C according to the second embodiment of the invention.

In Step S406, the mode is changed to three modes, that is, Mode A, Mode B and Mode C corresponding to the estimated amount of power consumption of the day of one month. Variations in temperature since the power source is turned ON in these modes are shown in FIG. 5A, FIG. 5B and FIG. 5C. In FIG. 5A, FIG. 5B and FIG. 5C, the lateral axis represents time since the power source is turned ON and the vertical axis represents the temperature.

Mode A is the default normal mode, and the electric energy is supplied from the main power source for commercial use. When the power source is turned ON, the temperature rises to the temperature Tn which is sufficient for fixation for copying or the like. Then, it enters into a waiting state and hence the temperature is lowered. However, when it receives a copy request, the temperature rises again to the temperature Tn. Thereafter, it returns back to the waiting state. A waiting time T1 is, for example, 15 minutes, and then it moves into a preheating state, where the temperature is lowered to the temperature Tp. A preheating time T2 is, for example, 15 minutes, and when a period of 15 minutes is elapsed, the state is moved into a sleeping state, where the fixing heater is turned OFF and hence the temperature is lowered to the temperature Ts, which is still lower than the temperature Tp. In Mode A, the processing such as copying can be performed most quickly. However, it is a mode whose power saving effect is the lowest.

In Mode B shown in FIG. 5B, normally, the mode is forcedly moved to the preheating mode with no waiting state after having finished copying and the preheating time T2 of about 15 minutes. When the preheating time is elapsed, the mode is changed to the sleep state in which the temperature is further lowered to the temperature TS. Since the control temperature is lowered to the temperature Tp, which is lower than the temperature Tn, Mode B has the power saving effect to some extent.

In Mode C, as shown in FIG. 5C, after having performed the copying operation, the mode is forcedly moved directly to the sleeping state without passing through the waiting state and the preheating state. Since the temperature control is not performed after having finished printing, Mode C is a mode which achieves the highest power saving effect.

As described above, one of Mode A, Mode B and Mode C is selected according to the estimated amount of power consumption of the day (Step S407). Then, in Step S408, whether or not a job processing such as copying is being performed is detected, and if yes, the mode is continued until the processing is finished, and when the job in question is finished, the procedure goes to the next step.

Figure 6:
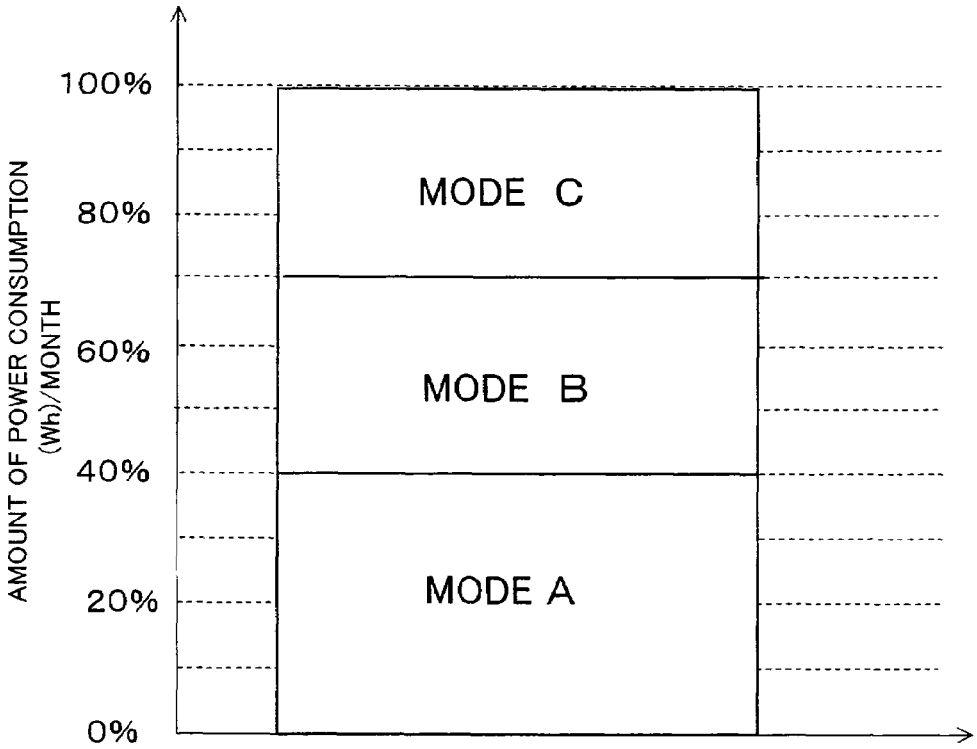
FIG. 6 is a drawing showing relations between a maximum power consumption and Mode A, Mode B and Mode C in the image forming apparatus according to the second embodiment of the invention.

As shown in FIG. 6, when the maximum amount of power consumption of each month is fixed, as the actual amount of power consumption approaches the maximum amount of power consumption, the mode is switched in the order of Mode A, Mode B and Mode C. In other words, the mode at the beginning of the month is Mode A, and when the actual amount of power consumption reaches 40% of the maximum amount of power consumption, the mode is switched from Mode A to Mode B, and when the actual amount of power consumption reaches 70% of the maximum amount of power consumption, the mode is switched from Mode B to Mode C.

Therefore, the procedure goes to Step S409 until the actual amount of power consumption reaches 40% of the maximum amount of power consumption, where the day of the week and the time-of-the-day of the day is detected, and in Step S410, the mode is moved to the power saving mode that corresponds to the above-described estimated amount of power consumption (Step S411). Switching of the power saving mode in this case can be performed in the same manner as the first embodiment described above.

On the other hand, before the actual amount of power consumption exceeds 40% of the maximum amount of power consumption and reaches 70%, the mode is moved to a mode in which the temperature is equal to or lower than that in the preheating mode, that is, to the preheating mode or the sleep mode from Step S412 on. Although the day of the week and the time-of-the-day of the day is detected in Step S409 and the mode is moved to the power saving mode in Step S410, the mode is not changed to the normal mode but is changed to the preheating mode or the sleep mode in Step S411 even though the mode which corresponds to the estimated amount of power consumption of the day of the week is the normal mode.

When the actual amount of power consumption exceeds 70% of the maximum amount of power consumption, the procedure goes from Step S413 to Step S411, where the mode is changed to the sleep mode. In this case, the actual amount of power consumption for every month is close to the maximum amount of power consumption, and hence it is necessary to enhance the power saving effect. Therefore, the image forming apparatus is always in the sleep mode even in the time zone of the day in which the power is significantly used.

When the procedure goes from Step S411 to Step S414 and a job request such as copy is issued, the job is executed from the previous power saving mode in Step S415, and the time-of-the-day is detected in Step S416. Then, the procedure goes back to Step S410, and the previous mode is restored in Step S411.

In this embodiment, since the power saving mode is selected while considering the maximum amount of power consumption of the respective months, the actual amounts of power consumption in the respective months are kept not to exceed the maximum amount of power consumption.

However, the invention is not limited to the above-described embodiments, and the power saving mode may be controlled according to the estimated amount of power consumption for the respective days also during one month as in the case of the one day base.

In this embodiment, the power saving mode is switched also during one day according to the day of the week, and during holidays or the like, the power saving effect can be increased according to the frequency of usage.

As described above, change among Mode A, Mode B and Mode C, data of a predetermined number of months, such as two-month data, may be averaged for each day of the week, to change the mode according to the day of the week. Alternatively, when the power consumption per month is fixed, selection of the mode may be such that the power consumption per month is divided by the number of in-service days per month, Mode A is selected before reaching, for example, 40% of the divided value, Mode B is selected before reaching 70%, and Mode C is selected after having reached 70%.

In both of the above-described embodiments, the power saving mode is changed on the basis of data obtained by measuring the amount of power consumption in the measuring phase before the control phase. However, when the estimated amount of power consumption is known in advance, it is also possible to change the power saving mode using the data. It is also possible to make a user select effectiveness or ineffectiveness of the automatic change of the power saving mode, as described above.

In the above-described embodiment, the amounts of power consumption are measured for a plurality of days or a plurality of months, and the measured amounts of power consumption are averaged to obtain the estimated amount of power consumption. However, the power saving mode can be controlled with data of the amount of power consumption for a day or for a month used as the estimated amount of power consumption.

It is also possible to display the amount of electric energy consumed during a predetermined term such as a day, a week or a month on a display panel and display the amount of electric energy after having converted into an amount of money.

The invention is not limited to the above-described embodiments and may be modified in various manners within the range of the technical idea of the invention.

What is claimed is:

1. An image forming apparatus comprising:

a heater heating unit configured to heat a heating member at a first waiting temperature lower than a temperature at which the heating member fixes a formed image or a second waiting temperature lower than the first waiting temperature when waiting for fixation of a formed image;

an amount of power consumption distribution acquiring unit configured to measure distribution of an amount of power consumed by the image forming apparatus in the respective days in a month with time and an amount of power consumption consumed by the image forming apparatus in the respective hours in a day to obtain an estimated amount of power consumption and to obtain a total actual power consumption for a present month; and a heat control unit that selects, upon completion of a fixation of a formed image, a first mode in which the heater control unit provides power to heat the heating member to the first waiting temperature, a second mode in which the heater control unit provides power to heat the heating member to the second waiting temperature, or a third mode in which power is not applied to the heating member, wherein the first mode is selected when the estimated amount of power consumption is significant, the second mode is selected when the estimated amount of power consumption is small, and the third mode is selected when the estimated amount of power consumption is even smaller, except the second mode is selected instead of the first mode when the total actual power consumption for the present month exceeds a first predetermined fraction of a predetermined maximum amount of power consumption for a month.

2. The image forming apparatus according to claim 1, wherein the heat control unit selects the third mode instead of the first mode or the second mode when the total actual power consumption for the present month exceeds a second predetermined fraction of the predetermined maximum amount of power consumption for a month.

* * * * *